US012745848B2

(12) United States Patent
Wilcox

(10) Patent No.: US 12,745,848 B2
(45) Date of Patent: Sep. 29, 2026

(54) FOLDING CHAIR WITH DETACHABLE CONTAINER

(71) Applicant: PARKIT CO., Oceanside, CA (US)

(72) Inventor: Steven Ellis Wilcox, Oceanside, CA (US)

(73) Assignee: PARKIT CO., Oceanside, CA (US)

( * ) Notice: Subject to any disclaimer, the term of this patent is extended or adjusted under 35 U.S.C. 154(b) by 0 days.

(21) Appl. No.: 19/644,742

(22) Filed: Apr. 10, 2026

(65) Prior Publication Data

US 2026/0240328 A1 Aug. 20, 2026

Related U.S. Application Data

(60) Continuation of application No. 18/785,591, filed on Jul. 26, 2024, now Pat. No. 12,622,526, which is a (Continued)

(51) Int. Cl.

| | |
|---|---|
| ***A47C 7/62*** | (2006.01) |
| ***A45F 4/02*** | (2006.01) |
| ***A47C 7/22*** | (2006.01) |

(52) U.S. Cl.

CPC ..... *A47C 7/626* (2018.08); *A45F 4/02* (2013.01); *A47C 7/22* (2013.01); *A47C 7/624* (2018.08)

(58) Field of Classification Search

CPC ..... A47C 7/626; A47C 7/662; A47C 7/624; A47C 7/22; A45F 4/02

See application file for complete search history.

(56) References Cited

U.S. PATENT DOCUMENTS

| | | | |
|---|---|---|---|
| 2,690,792 | A | 10/1954 | Douglas |
| D193,336 | S | 8/1962 | Batie et al. |

(Continued)

FOREIGN PATENT DOCUMENTS

| | | |
|---|---|---|
| CN | 302481123 | 6/2013 |
| CN | 302719149 | 1/2014 |

(Continued)

OTHER PUBLICATIONS

"Kingmodern Portable Lightweight Camping Chair Outdoor Small Stool Folding Waterproof Oxford Fabric Backrest Chair Hold up 13 L Cooler Bags", Retrieved from internet URL: https://www.amazon.com/Kingmodern-Portable-Lightweight-Waterproof-ArmyGreen/dp/B0839NT3DZ, on May 15, 2023, 7 pages.

(Continued)

*Primary Examiner* — Milton Nelson, Jr.
(74) *Attorney, Agent, or Firm* — Fish & Richardson P.C.

(57) ABSTRACT

Portable chairs including a detachable container. The container can be insulated for keeping beverages and food cold for an extended period. The folding chair preferably is designed and constructed for the demands of the outdoors. Various detachable, reconfigurable, and/or interchangeable features including the container, carrying straps, and cup holder. The container can be easily and conveniently attached and detached from the folding chair. The container can have exterior pockets which are welded and sealed to protect items contained within. The straps can have multiple different attachment points which allow multiple different carrying styles and reconfigurations including a backpack type carrying configuration, over-the-shoulder briefcase type carrying configuration, and across the body satchel type configuration, for example. The cupholder is interchangeable from each side of the folding chair and can be designed to accommodate various different types of beverage con- (Continued)

tainers including cups having a handle, a can, and a canteen, for example.

20 Claims, 16 Drawing Sheets

Related U.S. Application Data continuation of application No. 29/828,666, filed on Feb. 28, 2022, now Pat. No. Des. 1,073,346, which is a division of application No. 17/090,288, filed on Nov. 5, 2020, now Pat. No. 11,259,639.

(60) Provisional application No. 63/021,074, filed on May 6, 2020, provisional application No. 62/930,775, filed on Nov. 5, 2019.

(56) References Cited

U.S. PATENT DOCUMENTS

| | | | | |
|---|---|---|---|---|
| 3,077,327 | A | 2/1963 | Batie et al. | |
| 3,266,686 | A | 8/1966 | Griffith | |
| 4,063,701 | A | 12/1977 | Wray | |
| 4,148,376 | A | 4/1979 | Campbell, Jr. | |
| D261,834 | S | 11/1981 | Stebbins | |
| D271,581 | S | 11/1983 | Wood et al. | |
| 4,487,345 | A | 12/1984 | Pierce et al. | |
| 4,650,245 | A | 3/1987 | Nazar | |
| 4,772,068 | A | 9/1988 | Gleckler et al. | |
| 4,799,731 | A | 1/1989 | Brown | |
| 4,948,197 | A | 8/1990 | Sansing | |
| 5,054,848 | A | 10/1991 | Liu | |
| D338,782 | S | 8/1993 | Gibson et al. | |
| 5,257,765 | A * | 11/1993 | Halle | A47C 7/68 248/222.13 |
| 5,318,342 | A | 6/1994 | Hale | |
| 5,641,197 | A * | 6/1997 | Springmann | A47C 7/66 248/512 |
| 5,735,571 | A | 4/1998 | Colondona | |
| 5,865,124 | A | 2/1999 | Wroe | |
| 5,924,769 | A | 7/1999 | Kao | |
| 6,000,752 | A | 12/1999 | Shyr | |
| 6,048,023 | A | 4/2000 | Lampton | |
| 6,056,172 | A | 5/2000 | Welsh | |
| 6,082,816 | A | 7/2000 | Gottlieb et al. | |
| D434,234 | S | 11/2000 | Forrentino | |
| D438,719 | S | 3/2001 | Ford et al. | |
| 6,217,111 | B1 | 4/2001 | Tseng | |
| 6,390,345 | B1 | 5/2002 | Brown et al. | |
| 6,607,240 | B2 | 8/2003 | Zheng | |
| D481,547 | S | 11/2003 | Ammann, Jr. | |
| 6,739,652 | B2 | 5/2004 | Welsh | |
| 6,764,132 | B1 | 7/2004 | Gaertner | |
| RE39,022 | E | 3/2006 | Welsh | |
| D521,262 | S | 5/2006 | Wood | |
| 7,118,172 | B1 | 10/2006 | Pattison-Sheets | |
| 7,475,889 | B2 | 1/2009 | Marmah et al. | |
| 7,717,503 | B1 | 5/2010 | Watson | |
| 7,740,320 | B2 | 6/2010 | Chiang | |
| 8,113,396 | B2 * | 2/2012 | Schilly | A45F 3/047 224/155 |
| D672,161 | S | 12/2012 | McDowell | |
| D683,550 | S | 6/2013 | Ammann, Jr. | |
| 8,864,221 | B1 | 10/2014 | Delvilla | |
| D722,775 | S | 2/2015 | Thuma et al. | |
| D724,328 | S | 3/2015 | Thuma et al. | |
| D727,039 | S | 4/2015 | Thuma et al. | |
| D727,040 | S | 4/2015 | Thuma et al. | |
| D736,527 | S | 8/2015 | Thuma et al. | |
| 9,532,654 | B1 * | 1/2017 | Adams, IV | A47C 7/68 |
| D828,016 | S | 9/2018 | Gillespie et al. | |
| D831,366 | S | 10/2018 | Jin | |
| D839,016 | S | 1/2019 | Haingaertner | |
| D850,135 | S | 6/2019 | Yang | |
| 10,506,895 | B2 | 12/2019 | Mogil | |
| D911,057 | S | 2/2021 | Jacobsen | |
| D911,730 | S | 3/2021 | Doolan et al. | |
| D912,423 | S | 3/2021 | Sullivan et al. | |
| D935,211 | S | 11/2021 | Chen | |
| 11,259,639 | B2 | 3/2022 | Wilcox | |
| D955,132 | S | 6/2022 | Sullivan et al. | |
| 11,426,002 | B2 * | 8/2022 | Garrison | A47C 4/04 |
| D1,005,708 | S | 11/2023 | Wilcox | |
| 2002/0145326 | A1 | 10/2002 | Liu | |
| 2002/0171268 | A1 | 11/2002 | Liu | |
| 2004/0189062 | A1 | 9/2004 | Knight et al. | |
| 2004/0206790 | A1 | 10/2004 | Welsh | |
| 2005/0225126 | A1 | 10/2005 | Frederick | |
| 2005/0225136 | A1 | 10/2005 | Horton et al. | |
| 2008/0012399 | A1 | 1/2008 | Lin | |
| 2008/0078789 | A1 | 4/2008 | Fiola | |
| 2010/0026057 | A1 | 2/2010 | Miller | |
| 2010/0252589 | A1 | 10/2010 | Popescu | |
| 2011/0043007 | A1 | 2/2011 | Jones | |
| 2013/0193724 | A1 | 8/2013 | Gould et al. | |
| 2013/0257130 | A1 | 10/2013 | Wang | |
| 2018/0332953 | A1 | 11/2018 | Solomon et al. | |
| 2018/0338622 | A1 | 11/2018 | Doolan et al. | |
| 2018/0338623 | A1 | 11/2018 | Winterhalter et al. | |
| 2019/0045908 | A1 | 2/2019 | Zhu et al. | |
| 2019/0082846 | A1 | 3/2019 | Grace | |
| 2019/0090667 | A1 | 3/2019 | Mason et al. | |
| 2020/0289231 | A1 | 9/2020 | Gustafson et al. | |
| 2020/0383481 | A1 | 12/2020 | Cieszko et al. | |
| 2021/0045535 | A1 | 2/2021 | Wilcox | |

FOREIGN PATENT DOCUMENTS

| | | | |
|---|---|---|---|
| CN | 203506111 | | 4/2014 |
| CN | 307216534 | | 4/2022 |
| CN | 307540689 | | 9/2022 |
| EP | 2805643 | A1 | 11/2014 |
| GB | 2436521 | A | 10/2007 |
| JP | S58-029953 | Y2 | 7/1983 |
| JP | 2000335303 | A * | 12/2000 |
| JP | 2002325654 | A | 11/2002 |
| JP | D1217379 | | 9/2004 |
| JP | 2006181053 | A | 7/2006 |
| JP | 2011050641 | A | 3/2011 |
| KR | 300951418 | | 4/2018 |

OTHER PUBLICATIONS

"Leadallway Foldable Camping Chair with Cooler Bag Compact Fishing Stool," Retrieved from internet URL: https://www.leadallway.com/leadallway-foldable-camping-chair-with-cooler-bag-compact-fishing-stool-p3022586.html, on May 15, 2023, 6 pages.

"Voyager", Retrieved from internet URL: hllps://parkitmovemenl.com/products/the-voyager-chair?variant-31457158627401&currency=USD&utm_medium=product_sync&utm source=google&utm content=sag_ organic&utm_campaign=sag_organic&utm_campaign=gs-2021-03-01&utm source=google&utm_medium=smart_campaign&gclid=Cj0KCQjwz6ShBhCMARIsAH9A0qUmPh186hSOkbrF8Loy3_N_nz5V9JteXwvYRJWU8cy2YjCT1Jkf3_AaAnUfEALw_wcB, on May 15, 2023, 7 pages.

blog.naver.com [online], "Snow Peak Low Chair (LV-090)," Sep. 2, 2013, retrieved on Jun. 27, 2024, retrieved from URL <https://blog.naver.com/cch1778/50178696034>, 21 pages (with English translation).

Extended European Search Report in European Appln. No. 20884251.8, dated Nov. 24, 2023, 4 pages.

International Preliminary Report on Patentability in International Appln. No. PCT/US2020/059083, dated May 10, 2022, 11 pages.

International Search Report for PCT/US2020/059083 issued mailed Feb. 10, 2021, applicant Parkit Co., 3 pages.

Office Action in Japanese Appln. No. 2022-526354, mailed on Jul. 29, 2025, 30 pages (with English translation).

Parkit Camping Chair, retrieved from youtube.com, posting date Nov. 8, 2019, online, retrieved Aug. 4, 2023, https://www.youtube.com/watch?v=OrAOqobXDe4, 1 page.

(56) References Cited

OTHER PUBLICATIONS parkitmovement.com [online], "Voyager chair," Parkit, retrieved from URL: <https://parkitmovement.com/products/the-voyager-chair> [site visited on May 18, 2022], 4 pages.
Written Opinion of the International Searching Authority for PCT/US2020/059083 mailed Feb. 10, 2021, applicant Parkit Co., 10 pages.

* cited by examiner

FOLDING CHAIR WITH DETACHABLE CONTAINER

CROSS-REFERENCE TO RELATED APPLICATIONS

This patent application claims the benefit of and priority to U.S. patent application Ser. No. 18/785,591 filed on Jul. 26, 2024, which is a continuation of U.S. Design patent application Ser. No. 29/828,666 filed Feb. 28, 2022 (now U.S. Pat. No. D1,073,346), which is a divisional application of U.S. patent application Ser. No. 17/090,288 filed Nov. 5, 2020 (now U.S. Pat. No. 11,259,639); and which also claims the benefit of U.S. Provisional Patent Application Nos. 63/021,074 filed May 6, 2020 and 62/930,775 filed Nov. 5, 2019. The contents of which are hereby incorporated by reference in their entireties and for all purposes.

BACKGROUND

In the portable seating industry, a market exists for high performance folding chairs that are capable of efficiently and effectively withstanding heavy use and servicing large audiences. These seating situations are commonly found in gymnasiums, stadiums, auditoriums, schools and churches and at outdoor events, such as picnics and concerts. Due to the common nature of the events, the performance requirements for these chairs can be extremely demanding. For example, they must be able to withstand rugged use, such as that commonly found with sports fans and concert goers. And to also provide comfort for prolonged seating periods.

Many folding chairs tend be uncomfortable, especially in circumstances of extended seating time. For example, seats are commonly made of rigid materials, such as metal, plastic and/or wood. Such materials can become even more uncomfortable over time as their surface degrades and becomes weathered. Sometimes these rigid seats are covered with a layer of padding, such as foam, which may not be sufficient in thickness, resiliency and/or quality.

Moreover, these seat constructions tend to ignore the contours of the human body. For example, seating surfaces are commonly one dimensional, whereas the human body plainly is not so simple.

Folding chairs also tend to provide insufficient back support. One reason is that the back support is often minimized for a folding operation and for minimal storage space. For instance, backrest portions are typically much smaller than the human back. Backrests are also often made of a rigid material, such as metal, plastic or wood, which can become uncomfortable over time as previously mentioned, and ignores the contours of the human body. As with seats, backrests are sometimes covered with a layer of padding, such as foam, which may not be sufficient in every case. Also, backrests tend to be one-dimensional, as opposed to the human body. As a result, there is desire for a folding chair with a seat and backrest that provide enhanced comfort, particularly for high performance folding chairs used in preferred seating areas, and also the requisite durability for heavy and rugged use.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

The present invention relates to a folding chair having detachable, reconfigurable, and/or interchangeable features including a detachable, reconfigurable, and/or interchangeable container, carrying straps, and/or cup holder. The container can be insulated and can be easily and conveniently attached and detached from the folding chair. While referred to herein with reference to specific container embodiments as being insulated, in each instance it should be understood that the same disclosure is relevant to embodiments where the container is not insulated. Therefore, reference to insulated containers should be understood to also reference the same embodiments, discussion, and illustrations of which the container is not insulated.

The insulated container can be welded, insulated and sealed with exterior pockets which are also welded and sealed to protect items contained within. The straps can have multiple different attachment points which allow multiple different carrying styles and reconfigurations including a backpack type carrying configuration, over-the-shoulder briefcase type carrying configuration, and across the body satchel type configuration, for example. The cupholder can be interchangeable from each side of the folding chair and can be designed to accommodate various different types of beverage containers including cups having a handle, a can, and a canteen, for example.

A folding chair includes a chair frame. The chair frame can include a left front leg frame element, a right front leg frame element, a left rear leg frame element, a right rear leg frame element, and a seat frame including two or more seat frame elements. The seat frame element can include a first seat frame element and a second seat frame element. The folding chair can include an insulated container connectable and disconnectable to the chair frame such that the insulated container is disposed under a seat of the folding chair when the insulated container is connected to the chair frame. The seat can include seat material extending between the first seat frame element and the second seat frame element. A first side of the seat material at least in part provides the seat for a person to sit upon. A second side of the seat material extends over the insulated container when the insulated container is connected to the chair frame.

The folding chair frame can further include a left arm support frame element and a right arm support frame element. The folding chair frame can further include a left back support frame element pivotally connected to the left arm support frame element. The folding chair can further include a right back support frame element pivotally connected to the right arm support frame element. The folding chair can further include an upper back support frame element connecting the left back support frame element to the right back support frame element. The first seat frame element can include a left seat frame element and the second seat frame element can include a right seat frame element.

The chair frame can further include a left front joint, the left front joint coupling the left front leg frame element to the left seat frame element. The folding chair can further include a right front joint, the right front joint coupling the right front leg frame element to the right seat frame element.

The folding chair can further include a left rear joint, the left rear joint coupling the left rear leg frame element to the left seat frame element. The folding chair can further include a right rear joint, the right rear joint coupling the right rear leg frame element to the right seat frame element.

The left front joint can include a left front joint insulated container connector for connecting the left front joint to the insulated container. The right front joint can include a right front joint insulated container connector for connecting the right front joint to the insulated container. The left rear joint can include a left rear joint insulated container connector for connecting the left rear joint to the insulated container. The right rear joint can include a right rear joint insulated container connector for connecting the right rear joint to the insulated container.

The left front can include a left front joint cup holder connector for selectively connecting the left front joint to a cup holder. The right front joint can further include a right front joint cup holder connector for selectively connecting the right front joint to the cup holder.

The left rear joint can further include a left rear joint strap connector. The right rear joint can further include a right rear joint strap connector.

The folding chair can include a handle. The handle can be connected to two loops. The loops can be disposed around the upper back support frame element. The loops can be connectable to first ends of two carrying straps. Second ends of the two carrying straps can be connected to the left and right rear joint strap connectors for carrying the folding chair in a back pack configuration.

The folding chair can include a left arm rest made of wood and connected to and upper side of the left arm support frame element. A right arm rest made of wood and connected to an upper side of the right arm support frame element.

The second side of the seat material can extend over and is directly adjacent to the insulated container when the insulated container is connected to the chair frame.

The left front leg frame element can be connected to the right front leg frame element by a front leg ground surface frame element. The front leg frame element can be an integrated U-shaped front leg frame element.

The left rear leg frame element can be connected to the right rear leg frame element by a rear leg ground surface element. The rear leg frame element can be an integrated U-shaped rear leg frame element.

The seat frame can further include a front seat frame element, the first seat frame element and second seat frame element being connected by the front seat frame element. The seat frame element can be an integrated U-shaped seat frame element.

The back frame can further include an integrated U-shaped seat frame element.

The insulated container can include a plurality of straps sewn thereto and having connectors disposed proximate to opposing ends of the plurality of straps for connection to front and rear couplings of the folding chair.

The front and rear couplings can each include a clip connector for releasably connecting to the strap connectors of the insulated container. The rear couplings can be connected by a horizontal support brace. The horizontal support brace can be connected to the rear leg frame element by a rear support bracket.

One or more of the front pivotable couplings can include a connector for securing a cup holder thereto.

A method of configuring the foldable chair can include connecting a first strap in a satchel configuration, reconfiguring the first strap in a brief case configuration, and/or reconfiguring the first strap in a backpack configuration. The method of configuring the foldable chair can include connecting a second strap in the backpack manner.

An insulated container can include one or more connectors extending from an upper surface of the insulated container for selectively connecting the insulated container to a bottom of a chair frame.

A front pivotable coupling for a folding chair can include a first coupling element for connecting to a side of a seat support frame element, a second coupling element for connecting to a front leg frame element, and a connector for connecting to an insulated container. The front pivotable coupling can include a cup holder connector disposed around a periphery of the front pivotable coupling and configured to connect to an attachable cup holder.

A front pivotable coupling for a folding chair can include a first coupling element for connecting to a side of a seat support frame element, a second coupling element for connecting to a front leg frame element, and a connector for selectively connecting and disconnecting to cup holder.

A rear pivotable coupling for a folding chair can include a first coupling element for connecting to an end of a seat support frame element, a second coupling element for connecting to a back support frame element, and a connector for connecting to an insulated container. The rear pivotable coupling can further include a third coupling element for pivotably coupling to a horizontal brace. The third coupling element can be further configured to couple the rear pivotable brace to a pivotable bracket. The bracket can pivotably couple the rear pivotable coupling to a rear leg frame element.

The folding chair can further include one or more cup holders connected to the one or more front pivotable couplings.

The folding chair can further include arm rests connected to the left arm support frame element and right arm support frame element. The arm rests can be made of wood. The arm rests can be made of bamboo.

The folding chair frame can include aluminum. The front leg frame element, rear leg frame element, back support frame element, and seat support frame element can be made from aluminum. The front leg frame element, rear leg frame element, back support frame element, and seat support frame element can have a diameter of at least one inch.

The folding chair can have a fabric webbing connected to the seat and back support frame elements.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DESCRIPTION

Figure 1:
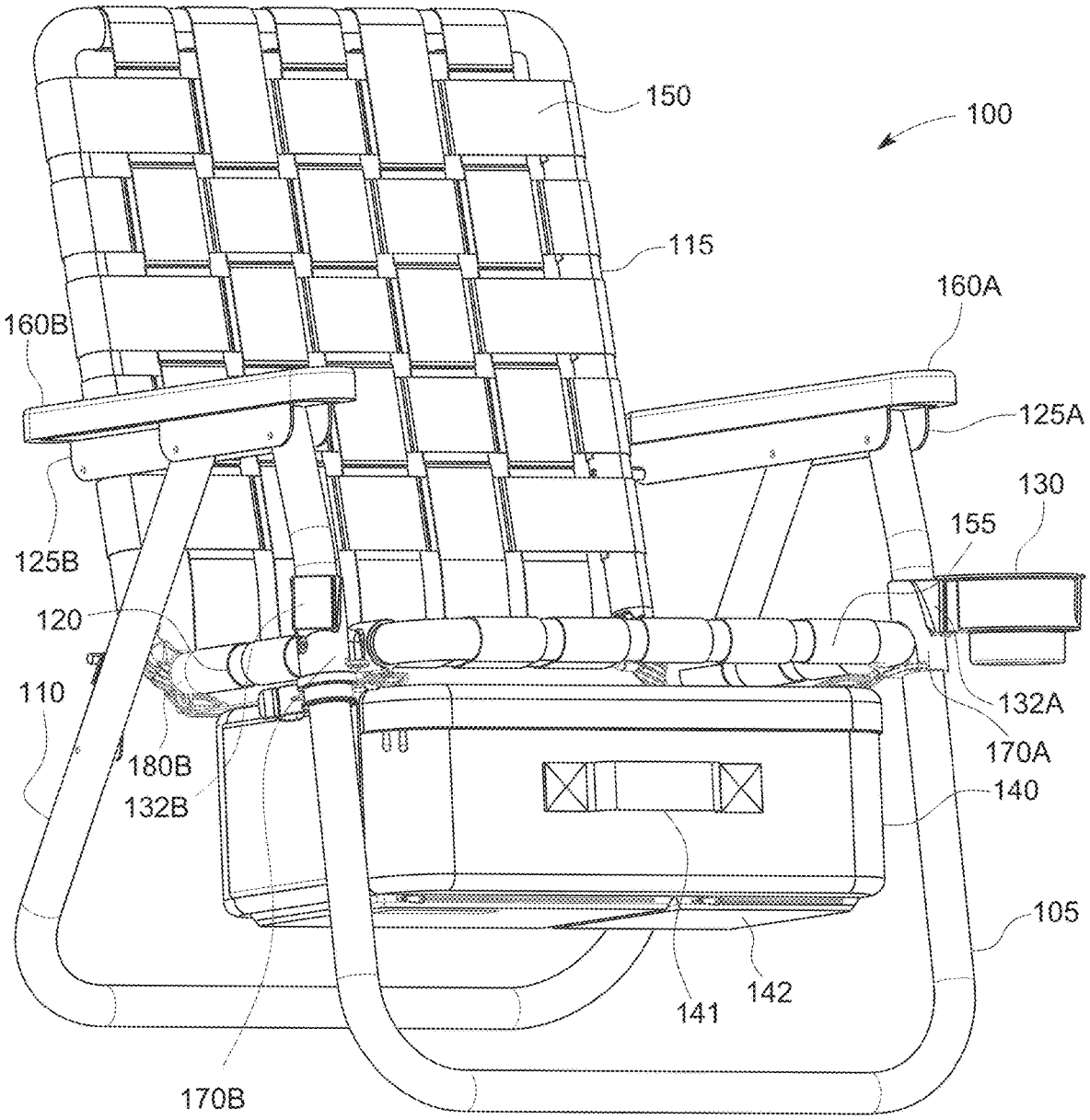
FIG. 1 illustrates a folding chair having an insulated container connected to a a seat frame.

Embodiments of the invention relate to a portable chair having superior craftsmanship and improved functionality. The portable chair includes a detachablecontainer, which can be insulated for keeping beverages and food cold for an extended period according to certain embodiments. The chair preferably is designed and constructed for the demands of the outdoors. The chair can be constructed of improved materials including, according to some preferred embodiments, a frame made from aircraft grade aluminum. The chair can include a seat and back made of fabric webbing that is soft to touch and encircles a nylon webbed core maintaining strength and "like new" comfort. The frabric webbing can include a woven polyester fabric that can be made water-resistant. The chair can have armrests, made of wood that can be laminated & sealed for elemental protection. The armrests can also be bamboo armrests that are lightweight, durable, and eco-friendly.

Other improvements and features which exhibit distinctive advantages include various detachable, reconfigurable, and/or interchangeable features including the insulated container, carrying straps, and cup holder. The insulated container can be easily and conveniently attached and detached from the folding chair. The insulated container can be welded, insulated and sealed with exterior pockets which are also welded and sealed to protect items contained within. The straps can have multiple different attachment points which allow multiple different carrying styles and reconfigurations including a backpack type carrying configuration, over-the-shoulder briefcase type carrying configuration, and across the body satchel type configuration, for example. The cupholder can be interchangeable from each side of the folding chair and can be designed to accommodate various different types of beverage containers including cups having a handle, a can, and a canteen, for example. Additional interchangeable accessory connection implements can accommodate umbrellas, tables, fishing rod holders, etc. as would be understood in view of the teachings disclosed hereinafter.

The detachable insulated container can be designed to keep ice frozen for more than eight hours, according to some preferred embodiments. The detachable insulated container can have soft or hard sidewalls and construction, or a mixture of soft and hard sidewalls and construction. The folding chair and insulated container can include exterior pockets to securely carry and protect additional items. Such exterior pockets can be welded as opposed to sewn so as to ensure a waterproof seam and streamlined appearance. According to certain preferred embodiments, the multiple carrying options provide for hands free carrying experience which is also ergonomically designed for comfort. Such multiple different carrying configurations can also lend to a wide variety of different carrying situations depending on the environment and desires of the user.

The detachable container can secure snugly to the underside of the seat base frame of the chair through carabiner-like clips according to certain preferred embodiments. Such convenient connection allows for easy access to the contents of the insulated container. In addition, the insulated container can be easily detached from the seat frame of the foldable chair for additional mobility, separate use, and as may otherwise be desirable in different circumstances.

A hands-free carrying strap runs across the chest in a satchel carrying configuration allowing freedom for the user's hands to carry additional equipment and items. According to various embodiments, the folding chair can be used to secure additional items such as snorkels, flippers, and other items within the folded chair for any particular use.

The interchangeable cup holder can be included with cutouts designed for cans, insulated water bottles, canteens, and coffee mugs. Advantageously, the interchangeable cup holder can be releasably connected to an innovative frame element joint as opposed to situated on, or formed in, the arm rest to provide an improved ergonomic, multi-functionality, reduction in parts, and multi-purpose joints for supporting rotatable frame elements in addition to the interchangeable cup holders.

Figure 2:
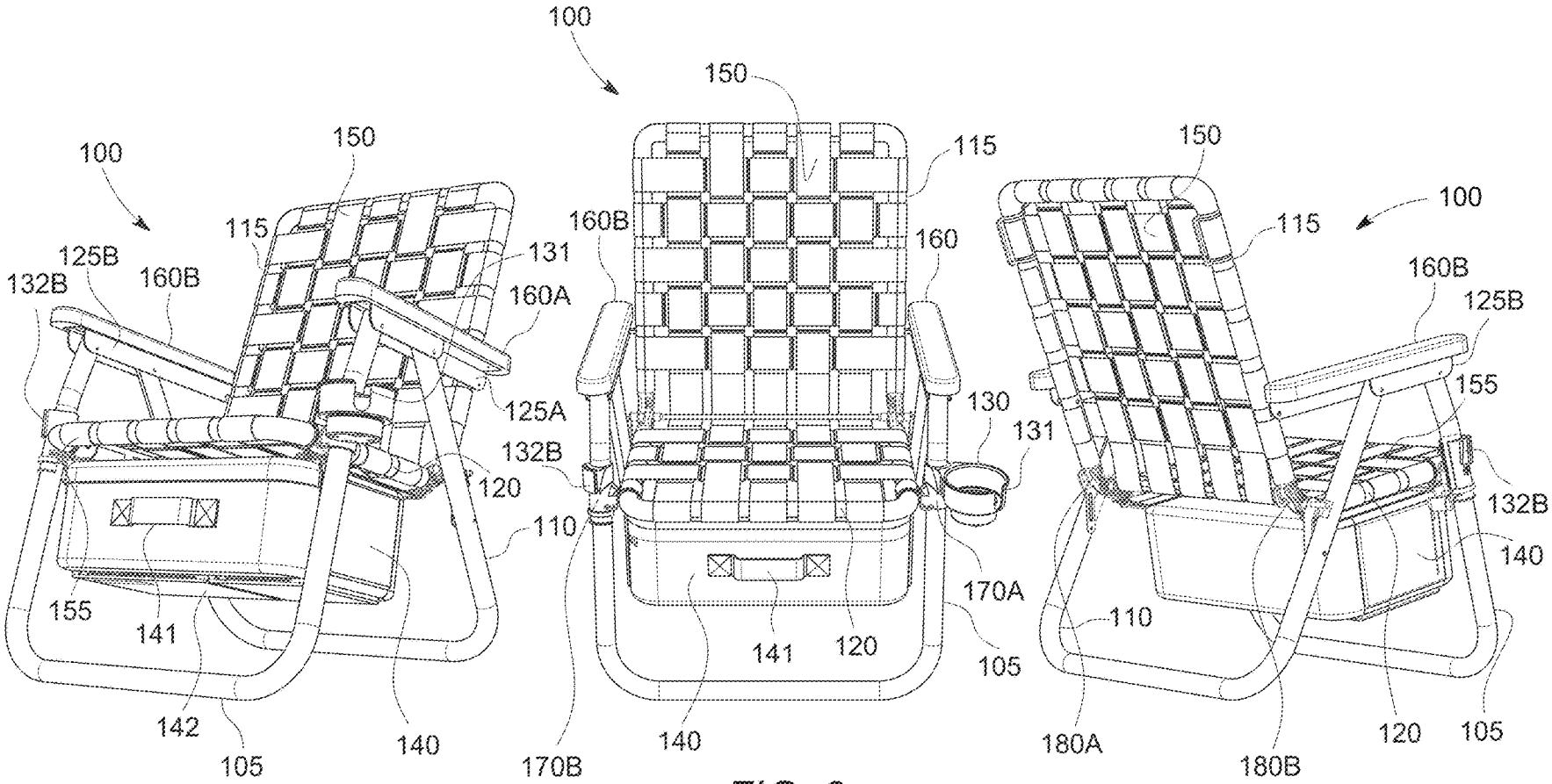
FIG. 2 illustrates the folding chair having the insulated container connected to the seat frame from a front, left and right view.

Referring to FIGS. 1 and 2, an embodiment of a folding chair 100 including an insulated container 140 is illustrated. The folding chair 100 includes a folding chair frame. The folding chair frame can include a left arm support frame element 125A and a right arm support frame element 125B.

The folding chair frame can further include a front leg frame element 105 pivotally connected to the left arm support frame element 125A. The front leg frame element 105 also being pivotally connected to the right arm support frame element 125B.

The folding chair frame can further include a rear leg frame element 110. The rear leg frame element 110 being pivotally connected to the left arm support frame element 125A. The rear leg frame element 110 also being pivotally connected to the right arm support frame element 125B.

The folding chair frame can further include a back support frame element 115 pivotally connected to the left arm support frame element 125A. The back support frame element 115 also being pivotally connected to the right arm support frame element 125B.

The folding chair frame can further include a seat support frame element 120. The seat support frame element 120 can be pivotally coupled to the rear leg frame element 110. The seat support frame element 120 can also be pivotally coupled to the front leg frame element 105.

The folding chair 100 can further include seat support material 155 and back support material 150. The back support material 155 can extend from the sides of the back support frame 115. The seat support material 155 can extend from the sides of the seat support frame element 120. The seat support material 155 and/or back support material 150 can include a webbing of seat and back support material. The webbing of material can include horizontal webbing interlaced with perpendicular horizontal seat support webbing material 155 or vertical back support webbing material 150 as shown in FIG. 1. The seat support material 155 and/or the back support material 150 can also be a sheet of material, strips of material or other configuration of material so as support the seat and back of a person sitting in the folding chair 100.

The folding chair 100 can further include a left arm rest 160A connected to the left arm support frame element 125A. The folding chair 100 can further include a right arm rest 160B connected to the right arm support frame elements 125B. The arm rests 160 can be made of any material. However, according to preferred particularly ergonomic designs, the arm rests 160 can be made of wood according to embodiments disclosed herein. For example, the arm rests 160 can be made of bamboo wood according to some preferred embodiments.

The folding chair 100 can include a cup holder 130. The cup holder 130 can be easily interchangeable from/to the left and right sides of the folding chair 100. The cup holder 130 can include a cutout 131 to accommodate a mug or handle of a cup. The cup holder 130 can be connectable and disconnectable to cup holder connectors 132. The folding chair 100 can include two cup holder connectors 132, one cup holder connector 132A on the left side of the folding chair 100 and one cup holder connector 132B on the right side of the folding chair 100. The cup holder 130 can be connected and disconnected to the cup holder connectors 132 on each side of the folding chair 100 as preferred by the person sitting in the folding chair 100. Advantageously, the cup holder connectors 132 can be coupled, attachable or attached to the front leg frame element 105 as well coupled, attachable or attached to the seat frame element 120. For example, the cup holder connectors 132 can include an interlocking or mating slot that corresponds to an interlocking or mating key or protrusion disposed on the cup holder 131.

Figure 3:
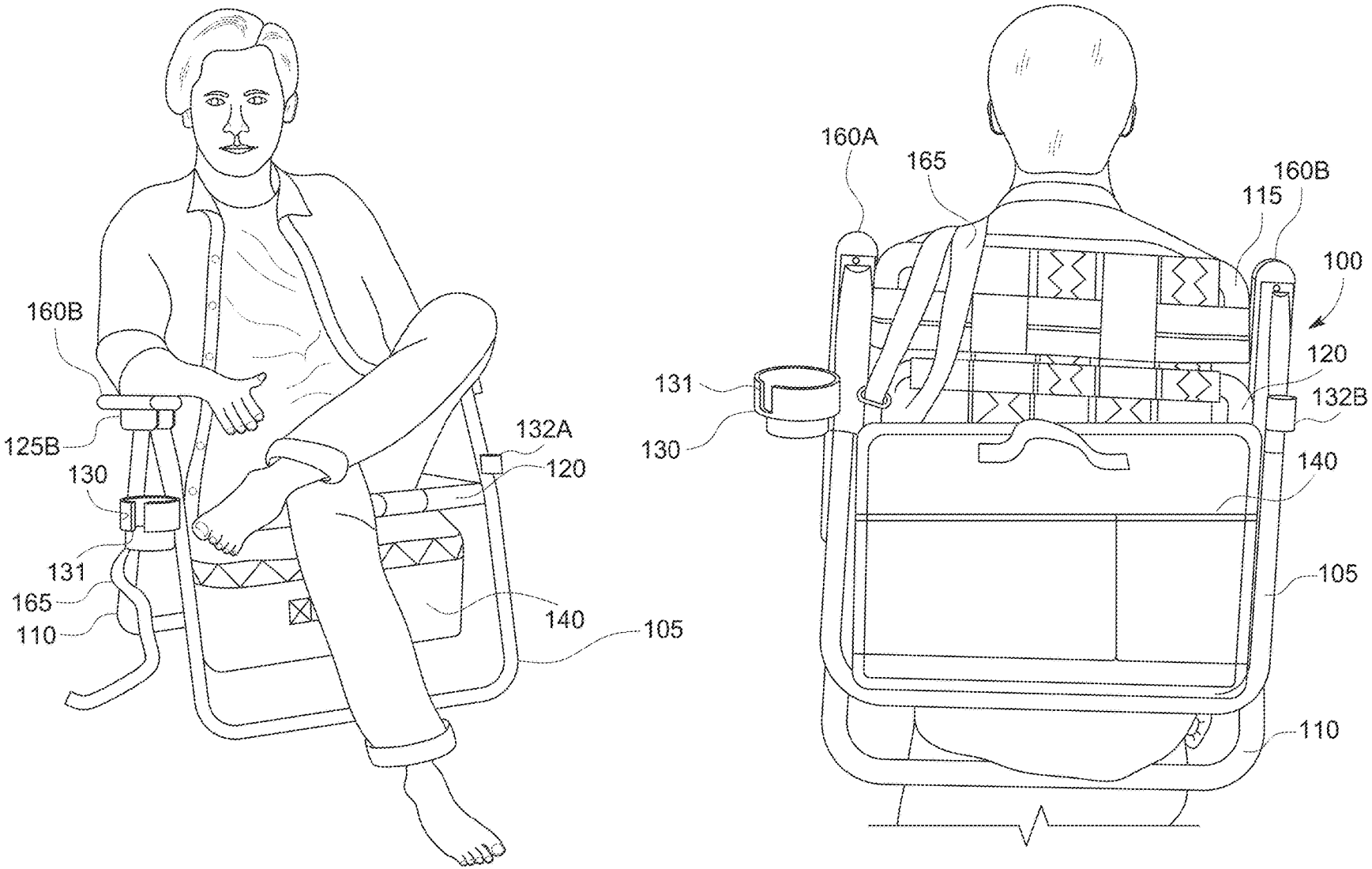
FIG. 3 shows a person carrying the folding chair with the insulated container and sitting on the folding chair with the insulated container.

Referring to FIG. 3, the folding chair 100 including the insulated container 140 is shown with a person sitting on the chair on the left of FIG. 3 as well as the person carrying the folded folding chair 100 on the right of FIG. 3. As shown in FIG. 3, the insulated container 140 is easily accessible to the person in the sitting position and is easily carried by the connectable and reconfigurable strap 165 in the folded position.

Figure 4:
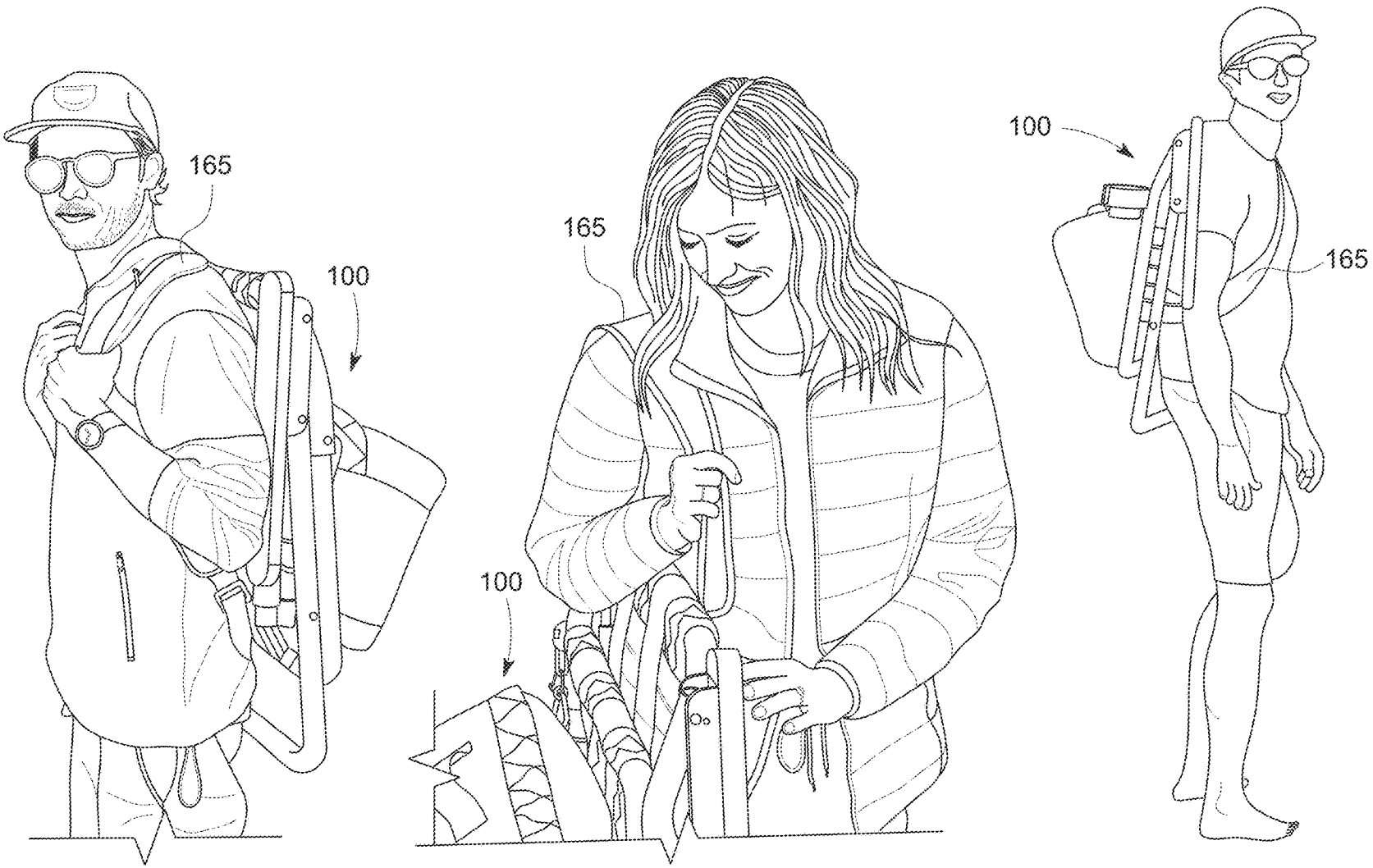
FIG. 4 shows people carrying the folded chair with the insulated container and a carrying strap in a backpack, satchel, and brief case configuration.

Referring to FIG. 4, the folding chair 100 is shown with three different configurations of one or more connectable and disconnectable carrying straps 165. In a first configuration on the left the straps 165 are configured in a backpack configuration. In a second configuration in the middle a strap 165 is in a briefcase carrying configuration over the woman's shoulder. And, in the third configuration on the right the reconfigurable strap 165 is in a satchel configuration over the man's shoulder and across his chest.

Figure 5:
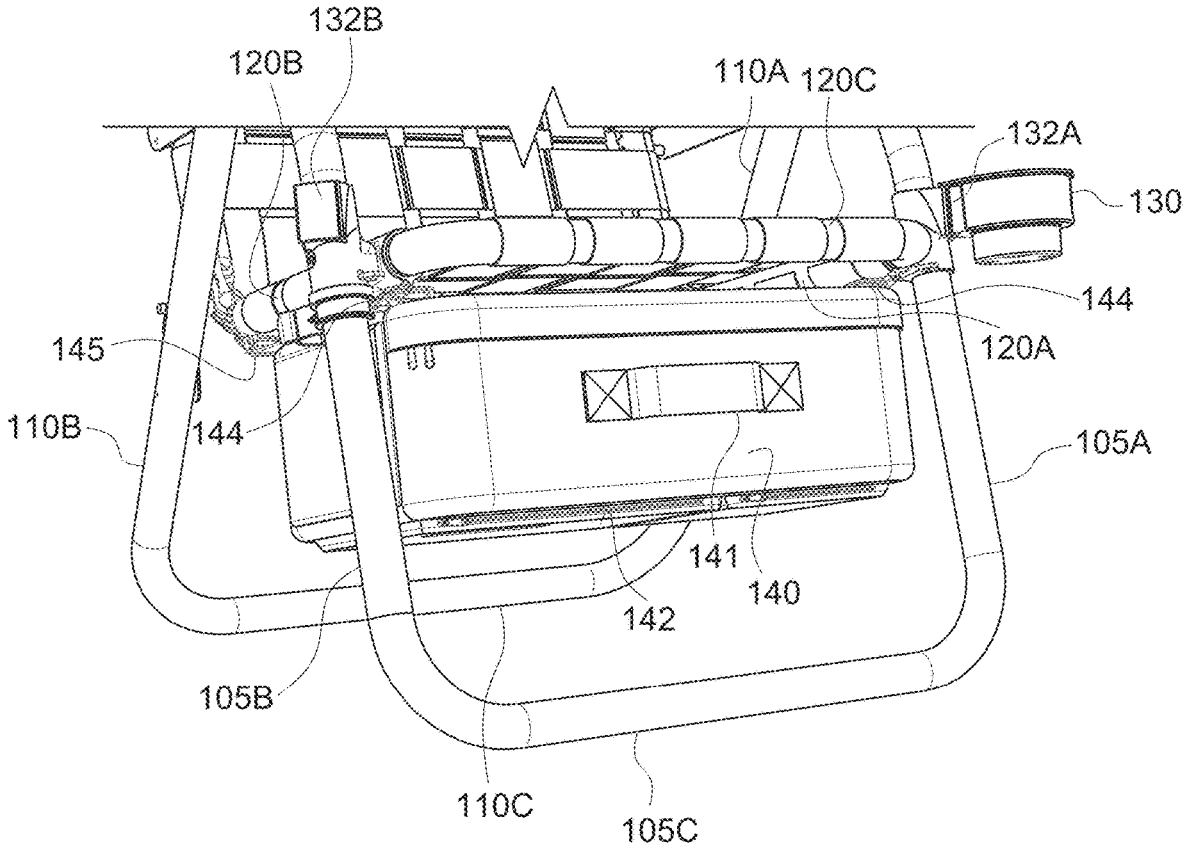
FIG. 5 shows the interchangeable cup holder connectors and insulated container with welded exterior pockets in further detail.

Referring to FIG. 5 additional optional and advantageous components of the insulated container 140 are illustrated. The insulated container 140 includes a handle 141. The handle 141 can be used to carry the insulated container 140 when disconnected from the frame of the folding chair 100.

The insulated container 140 can be connectable and disconnectable by front connectors 144 and rear connectors 145 of the insulated container 140. The front connectors 144 and rear connectors 145 can be in the form of loops, clips, or hooks attached, coupled, or connected to the insulated container 140, for example.

The insulated container 140 can also include one or more exterior pockets 142. For example, as shown in FIG. 5, the insulated container 140 can include pockets 142 with closure devices, such as zippers. The insulated container 140 can include one or more bottom pockets 142 and/or one or more side pockets (not shown) as illustrated in FIG. 5. The pockets 142 can be welded as opposed to sewn in some embodiments to ensure a water-tight seam between the pockets 142 and the insulated container 140.

The folding chair 100 is illustrated in the figures as having a generally U-shaped front leg frame element 105, U-shaped seat support frame element 120, U-shaped rear leg support frame element 110 and U-shaped back support frame element 115 interconnected by multiple couplings, folding joints and/or pivotable joints. However, individual or distinct portions of the back support frame element 115, leg support frame elements 105 and 110, and seat support frame elements 120 may be implemented. Use of U-shaped frame elements 105, 120, 110 and 115 renders various improvements, functional strength, and ergonomic benefits as discovered by the inventor of this patent application.

For example, referring still to FIG. 5, the folding chair 100 can include the chair frame having a left front leg frame element portion 105A and a right front leg frame element portion 105B. The left front leg frame element portion 105A can, but need not, be connected to the right front leg element 105B by an interconnecting front leg frame element portion 105C. The elements of the front leg frame element 105 can be a U-shaped single integrated support frame element or can be separate individual portions according to embodiments not specifically illustrated. Any element of the frame elements can be made from singles frame elements which may be bent to perform structural support functions, or may be multiple individual support frame elements which may be connected our coupled together or designed for different configurations or individual functionality.

Similarly, the rear leg frame element 110 can include a left rear leg frame element portion 110A and a right rear leg frame element portion 110B. The left rear frame element 110A can be, but need not, be connected to the right rear leg element 110B by an interconnecting rear leg frame element portion 110C. As shown, the elements of the rear leg frame element 110 can be a single piece as shown or separate pieces (not shown) which may be coupled together according to some embodiments.

Similarly, the seat frame element 120 can include two or more seat frame element portions. As illustrated in FIG. 5, the seat frame element 120 can include a first seat frame element portion 120A and a second seat frame element portion 120B. The first seat frame element portion 120A can be a left seat frame element portion and the second seat frame element portion 120B can be a right seat frame element portion 120B. The first seat frame element portion 110A can be connected to the right seat frame element portion 110B by an interconnecting seat frame element portion 110C. As shown, the elements of the seat frame element 120 can be a single piece or separate pieces. Similar teachings can be understood with reference to the back support frame element 115 as would be understood to one of ordinary skill in the art in view of the foregoing teachings.

Referring to FIGS. 6-10, the folding chair can further include multiple couplings and joints adjoining two or more of the front leg frame element 105, rear leg frame element 110, back support frame element 115, seat support frame element 120, and cup holder connectors 132. The couplings and joints can further include, and be integrated with in some embodiments, connectors for connecting the coupling joints to the one or more carrying straps 165 and insulated container 140.

For example, the foldable chair 100 can include two front couplings 170 and two rear couplings 180. The front couplings 170 can have a first front coupling joint portion 170A for connecting to the front leg frame element 105 and a second front coupling joint portion 170B for connecting to the seat frame element 120. The first front coupling joint portion 170A is rotatably connected to the second front coupling joint 170B such that the seat frame element 120 is rotatably coupled to the front leg frame element 105.

Figure 7:
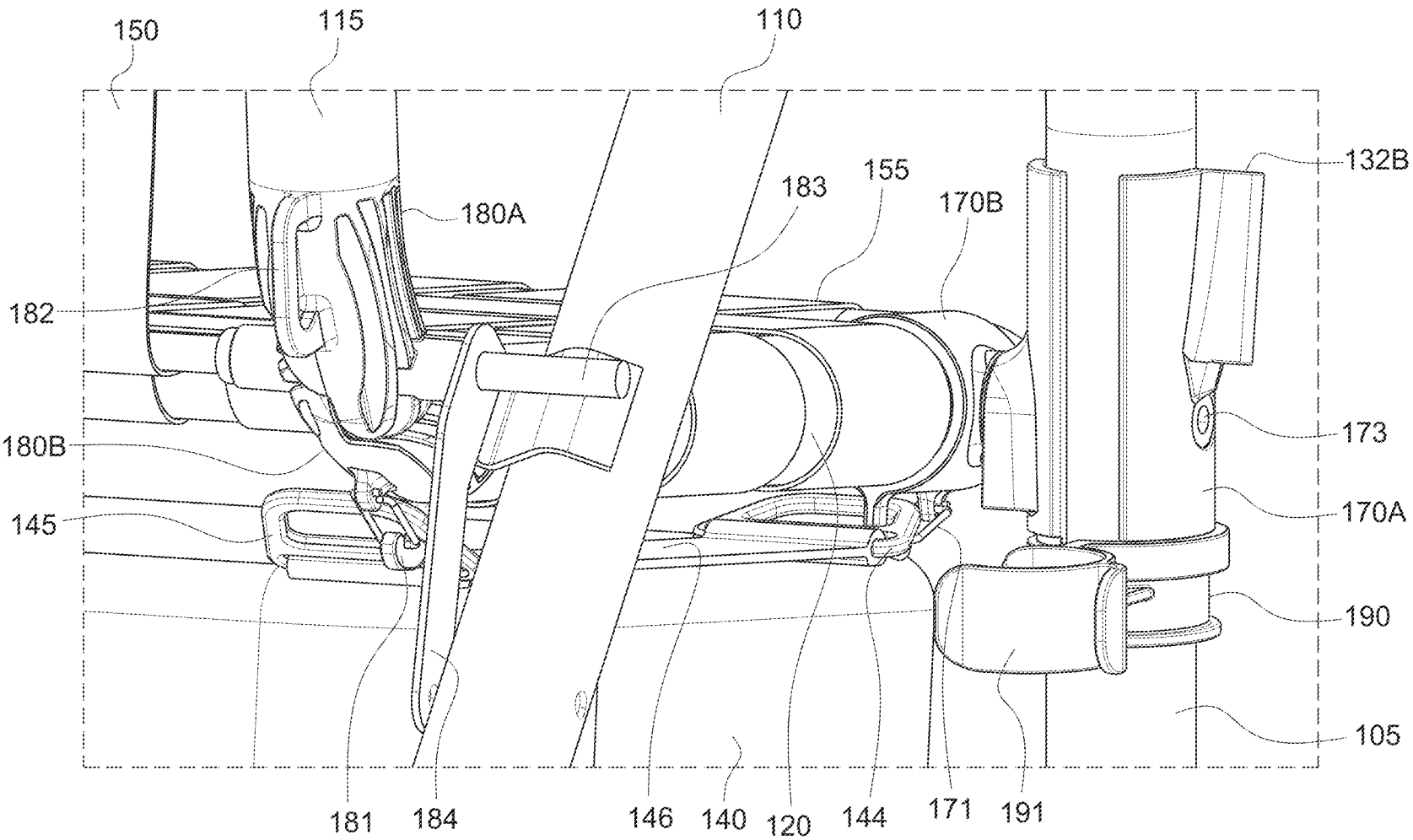
FIG. 7 shows the rear coupler having integrated connectors for connecting to the insulated container and carrying strap(s)
Figure 8:
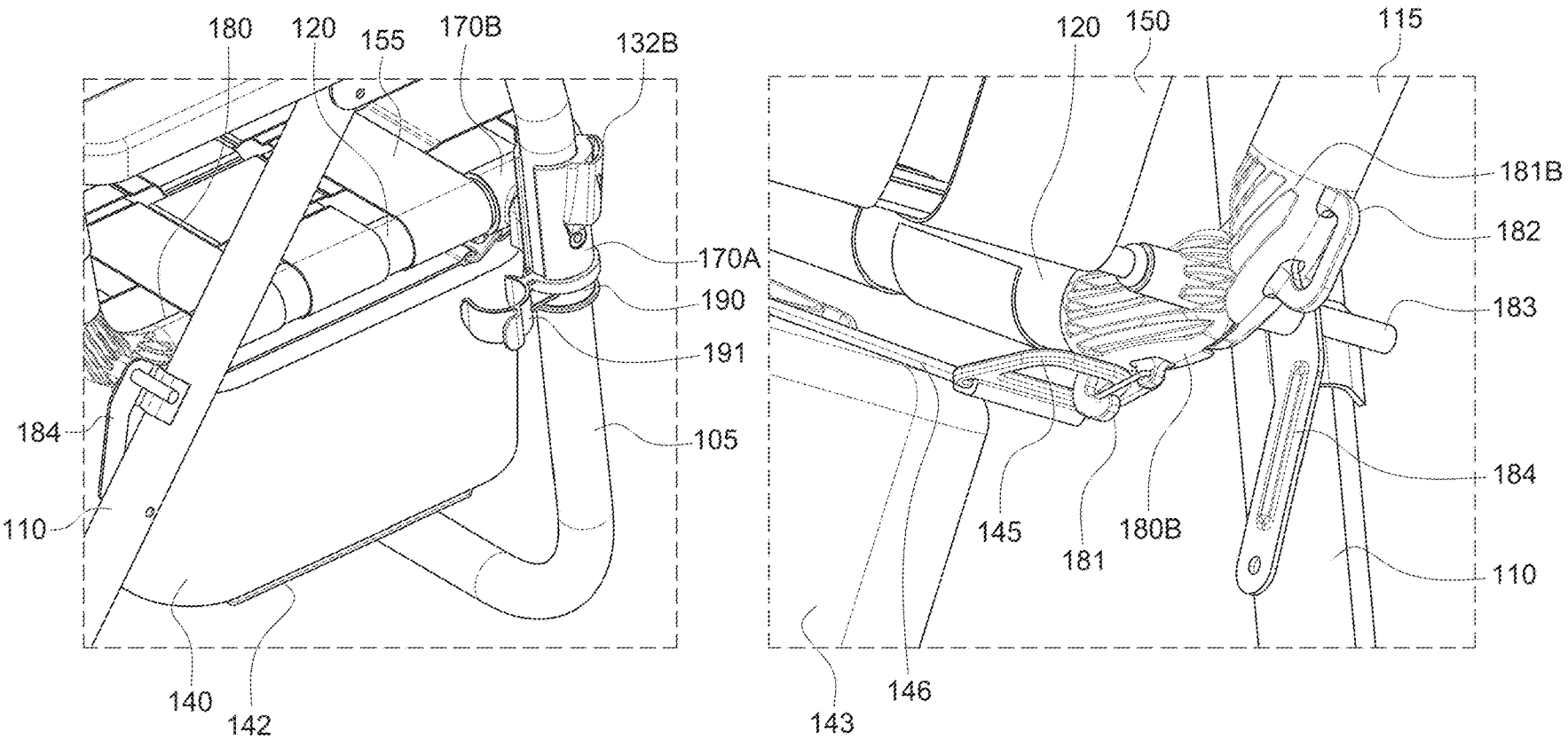
FIG. 8 illustrates additional examples and views of the front and rear couplers as well as an example of a closure retention element.
Figure 9:
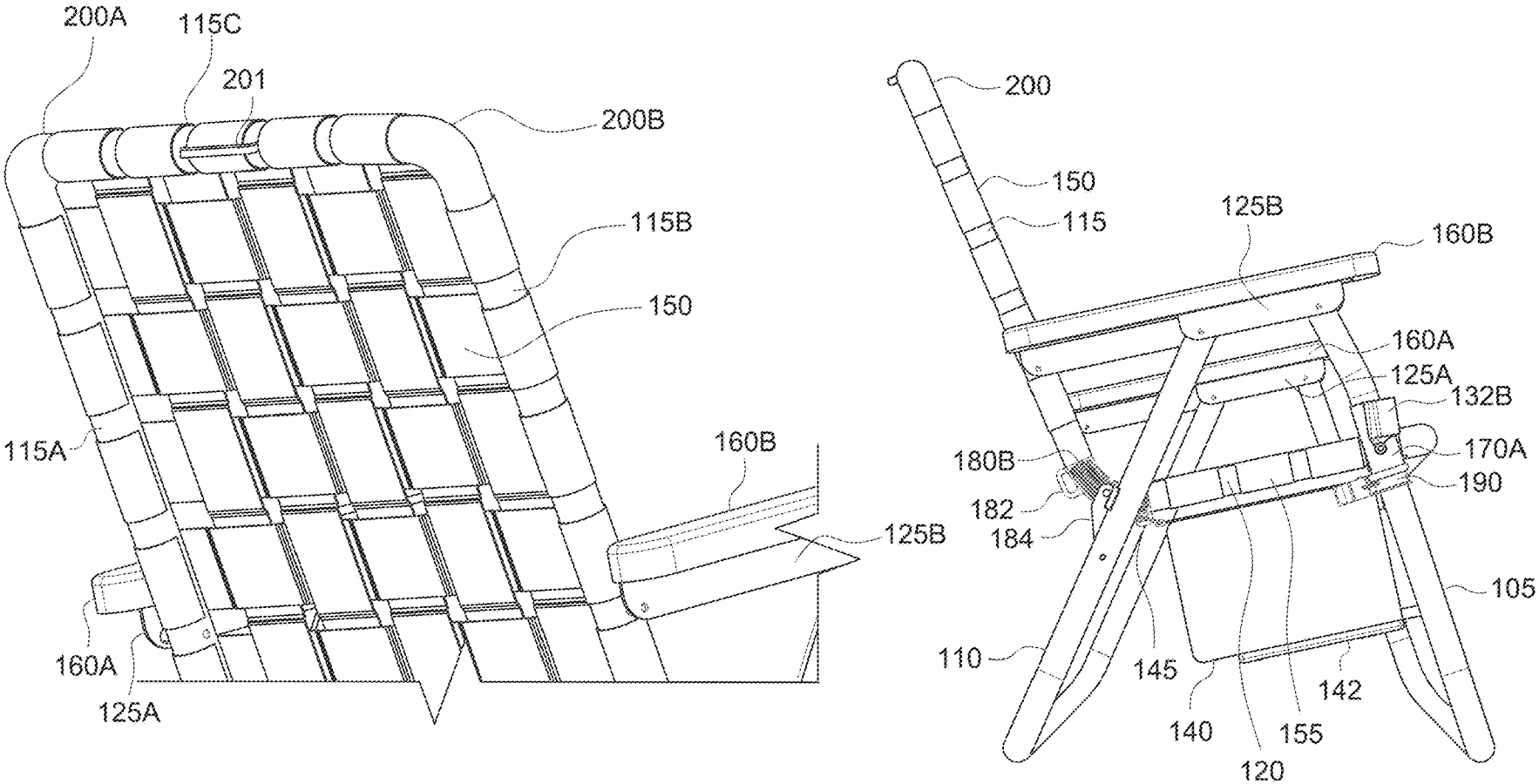
FIG. 9 illustrates additional features of the folding chair with the detachable and independently usable insulated container.
Figure 10:
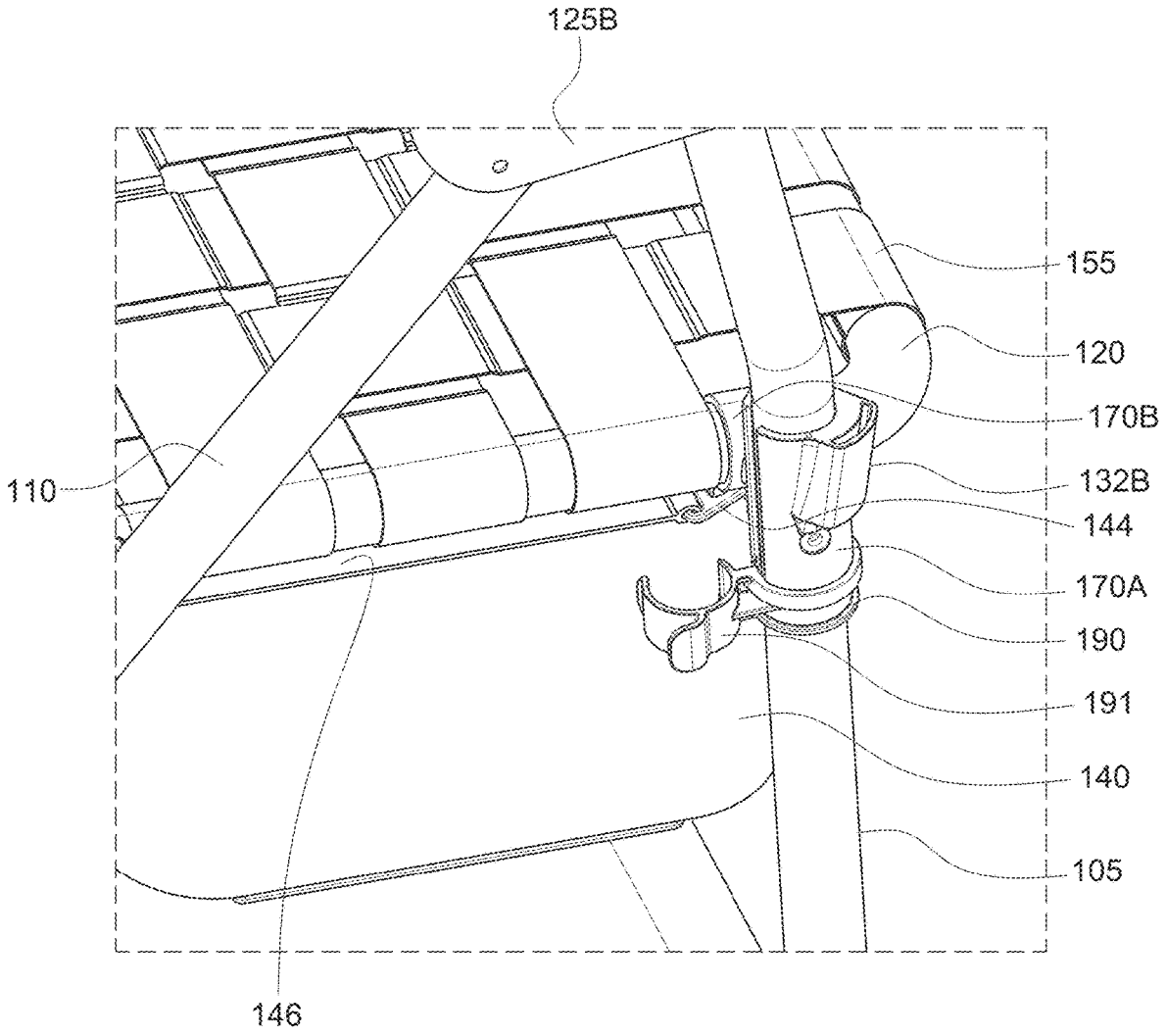
FIG. 10 illustrates additional features of the cup holder connector and an example of a closure retention element.
Figure 11:
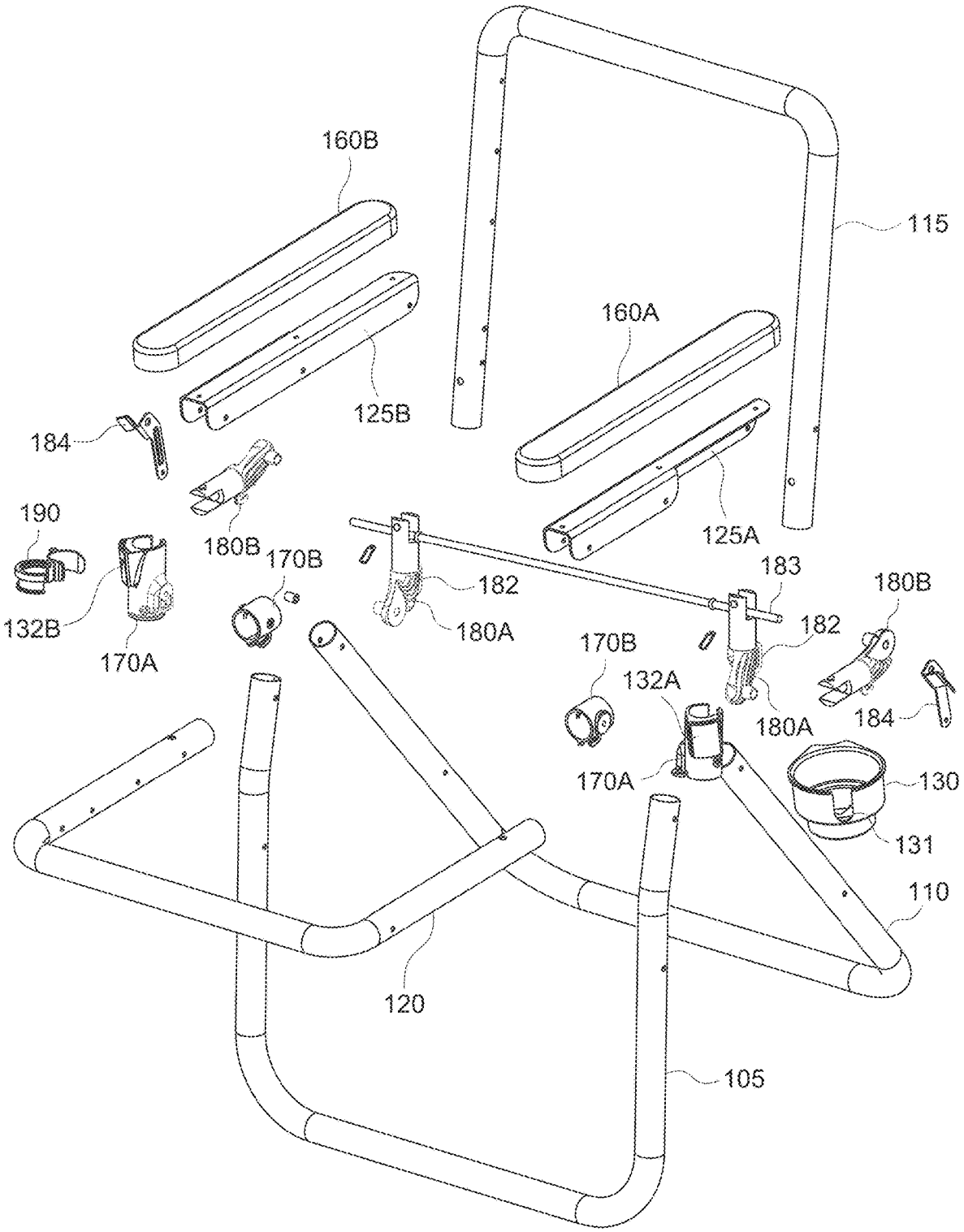
FIG. 11 is an exploded view of various examples of elements of the folding chair.

As shown in FIG. 7, the front coupling joints 170 can include a pivot rod 173 extending through the first front coupling joint portion 170A and the second front coupling joint portion 170B providing for the rotation of the first front coupling joint portion 170A relative to the second front coupling joint portion 170B while providing support for a person sitting upon the seat of the folding chair 100.

Figure 6:
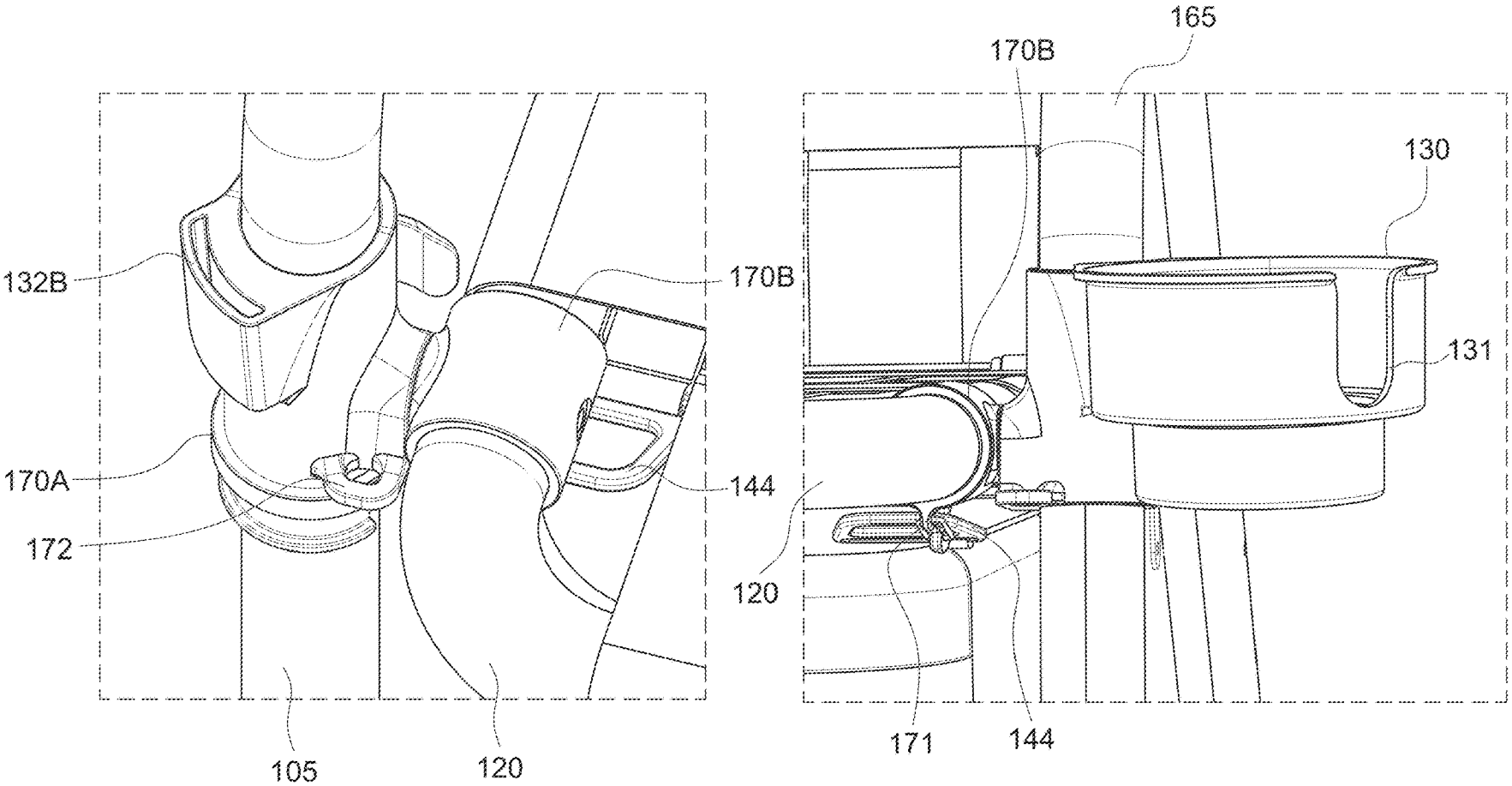
FIG. 6 shows the front coupling joint having the interchangeable cup holder connector as wells as connectors for connecting to the insulated container and carrying strap(s)

The front coupling joints 170 can further include first front coupling connectors 171 for connecting the second front coupling joint portions 170B of each front coupling joint 170 to the insulated container 140. For example, as shown, the first front coupling connector 171 can include an integrated clip like a carabiner for connecting to a front connector 144 of the insulated container 140. As shown in FIG. 7, front connectors 144 of the insulated container 140 can be affixed to a top side of the insulated container 140 by straps 146 sewn or otherwise attached the upper side of the insulated container 140. The front coupling joints 170 can further include a second front coupling joint connector 172 as shown in FIG. 6 for connecting and disconnecting the front coupling joints 170 to an end of a carrying strap (not shown).

The folding chair frame can further include two rear rotatable and foldable couplings 180. The rear couplings 180 can foldably couple ends of the back support frame element 115 to ends of the seat support frame element 120. The rear couplings 180 can further rotatably couple the back support frame element 120 and the seat support frame element 120 relative to the rear leg frame element 110.

More specifically, as shown in FIG. 7 the right rear coupling 180 is illustrated and includes two foldable rear coupling portions 180A and 180B. The first foldable rear coupling portion 180A connects to the back support frame element 115. The second foldable rear coupling portion 180B connects to the seat frame element 120. When in the folded position (not shown), the back support frame element 115 is folded over against the seat support frame element 120. Moreover, due to the rotational connection of the rear leg support frame element 110 to the rear couplings 180, the rear leg support frame element 110 is rotatable into the folded position adjacent to and approximately parallel to the seat support frame element 120, back support frame element 115 and front leg support frame element 105 as well. The rotation and support of the seat frame element 120 is enabled by a pivotable support rod 183 coupled to the rear leg frame element 110 by a rotation support fame arm 184.

The rear couplings 180 further can further include a first rear coupling connector 181 for connecting the rear couplings 180 to the insulated container 140. The first rear coupling connector 181 can be formed integral with the second portion 180B of the rear couplings 180. The first rear coupling connectors 181 can be similar in function to a carabiner with a metallic clip biased into the closed position.

The rear couplings 180 can further include a second rear coupling connector 182 for connecting and disconnecting to a carrying strap (not shown). Thus, the foldable chair can include one, two, three or four front and rear coupling connections for selectively connecting the one or more carrying straps (e.g. see FIG. 4) to both sides of the front and/or back of the seat of the foldable chair 100 by the second rear coupling connectors 182 as shown in FIG. 7 and by the second front coupling joint connectors 172 as shown in FIG. 6.

The folding chair portion 100 can further include the seat support material 155 and back support material 150. The fabric of the seat support material 155 and back support material 150 can include fabric webbing of fabric strips. The fabric straps can include longitudinal strips of material that extend from a top end of the back support element 125 to an end of the seat support element 130. Transverse strips of the seat support material 155 and back support material 150 can extend transverse to side of the back support element 125 and sides of the seat support element 130 and connect to opposing sides thereof. A design of the fabric of the seat support material 155 and back support material 150 of the folding chair 100 can be tailored to coincide with a design of fabric or wall pattern of the insulated container 180. The strips of the seat support material 155 and back support material 150 of the folding chair 100 can be woven or can be a single or multiple sheets of fabric.

The folding chair frame can include the two front pivotable couplings 170. The front pilotable couplings 170 rotatably coupling ends of the seat support frame element 120 to the front leg frame element 105. The folding chair frame can further include the two rear pivotable couplings 180, the rear pivotable and foldable couplings 180 rotatably coupling ends of the back support frame element 115 and the seat support frame element 120 to the rear leg frame element 110.

The insulated container 180 can be connected to the two front pivotable couplings 170 and two rear pivotable and foldable couplings 180. And, the insulated container 180 can have the handle 141 (not shown) attached thereto for carrying the insulated container 140 when the insulated container 140 is disconnected from the front pivotable couplings 170 and rear pivotable and foldable couplings 180.

The foldable chair portion 100 further including the arm rests 160 connected to the left arm support frame element 125A and the right arm support frame element 125B. The arm rests 160 can be made of wood such as bamboo.

Figure 12:
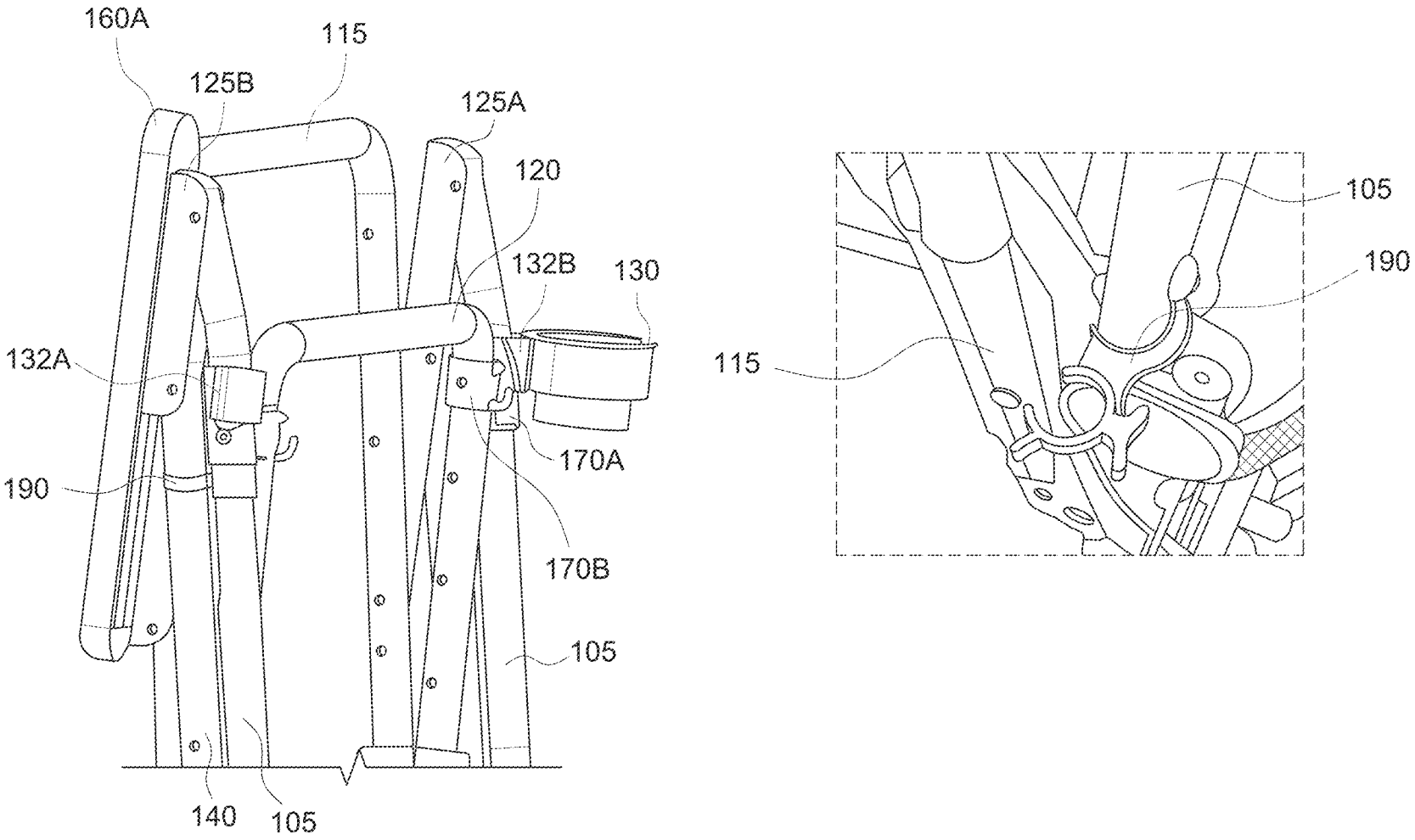
FIGS. 12, 13, and 14 illustrate further examples of closure retention elements.

The foldable chair portion 110 can further include various different releasable closure retention mechanisms. For example, referring to FIGS. 5 and 7-12 a first embodiment of a folding chair closure retention element 190 is illustrated. According to this embodiment, the folding chair closure retention element 190 includes a rotatable clip rotatably connected to the front leg support frame element 105. When the folding chair 100 is placed in the folded position the folding chair closure retention element 190 is rotated about the a center axis of the front leg support frame element 105 and clips onto the rear support frame element 110 as shown in FIG. 12.

Figure 13:
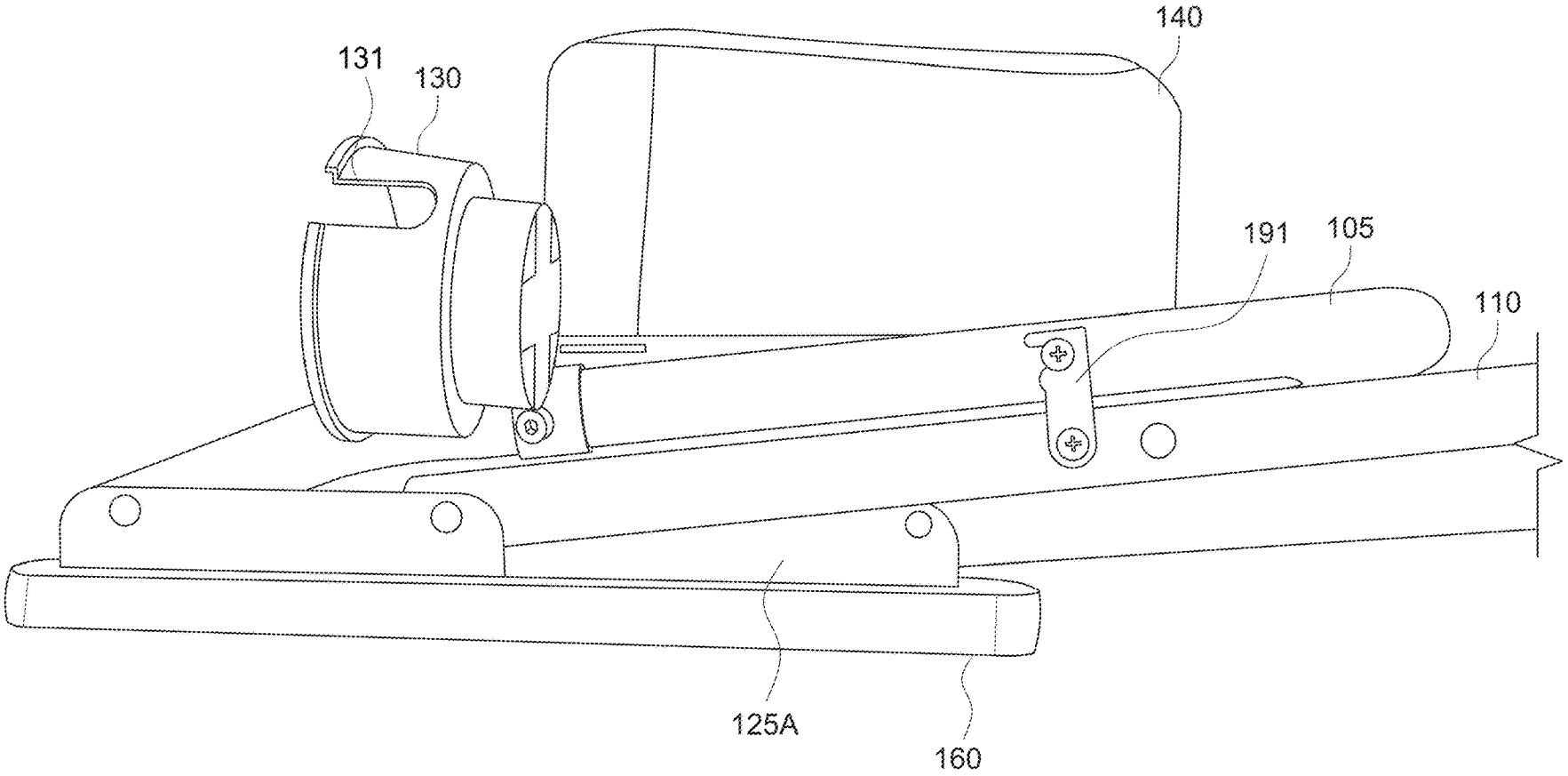

Referring to 13 a second embodiment of a folding chair closure retention element 191 is illustrated. According to this embodiment, the folding chair closure retention element 190 includes a rotatable clip rotatably connected to a side of the front leg support frame element 105. When the folding chair 100 is placed in the folded position the second folding chair closure retention element 191 is rotated perpendicular the a center axis of the front leg support frame element 105 and clips onto a post connected to the rear support frame element 110 as shown in FIG. 13.

Referring to 13 a second embodiment of a folding chair closure retention element 191 is illustrated. According to this embodiment, the folding chair closure retention element 190 includes a rotatable clip rotatably connected to a side of the front leg support frame element 105. When the folding chair 100 is placed in the folded position the second folding chair closure retention element 191 is rotated perpendicular the a center axis of the front leg support frame element 105 and clips onto a post connected to the rear support frame element 110 as shown in FIG. 13.

Figure 14:
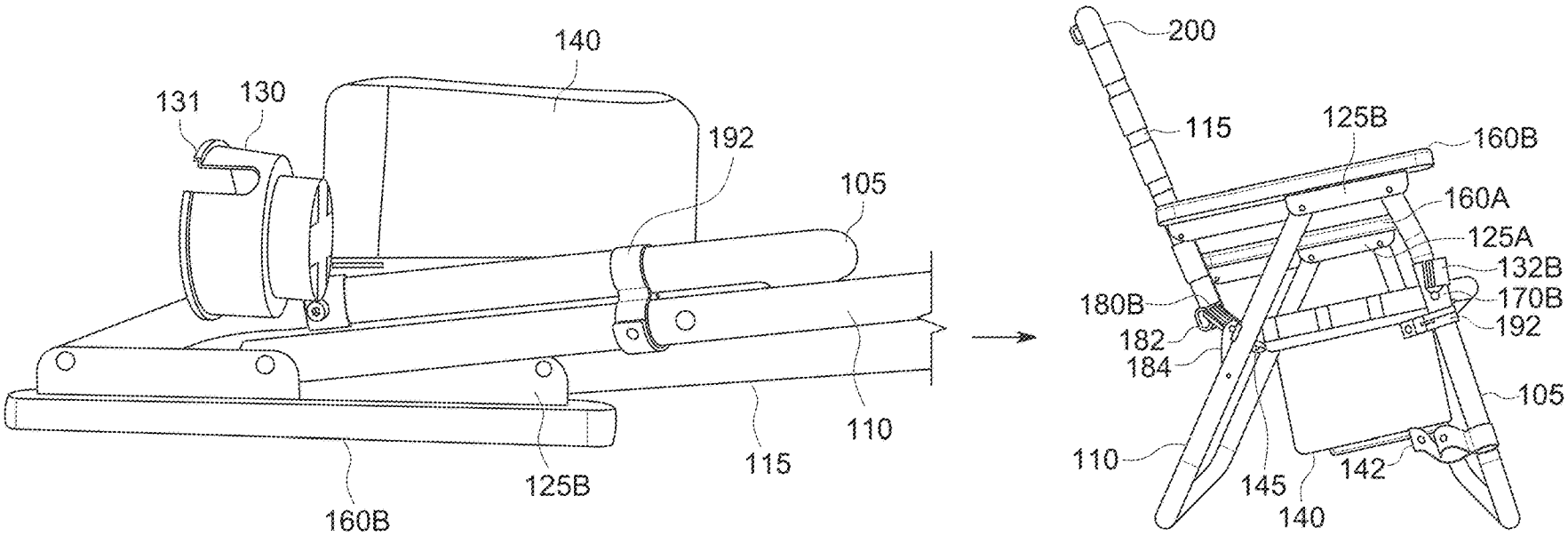

Referring to FIG. 14 a third embodiment of a folding chair closure retention element 192 is illustrated. According to this embodiment, the folding chair closure retention element 190 includes a strap connected to a side of the front leg support frame element 105. When the folding chair 100 is placed in the folded position the third folding chair closure retention element 192 is wrapped around the rear support frame element 110 as shown in FIG. 14. The third chair closure retention element 192 includes a snap, VELCRO, or other connecting element for releasably retaining the strap of the third folding chair closure retention element 192 in place and securing the folding chair 100 in the folded position.

Figure 15:
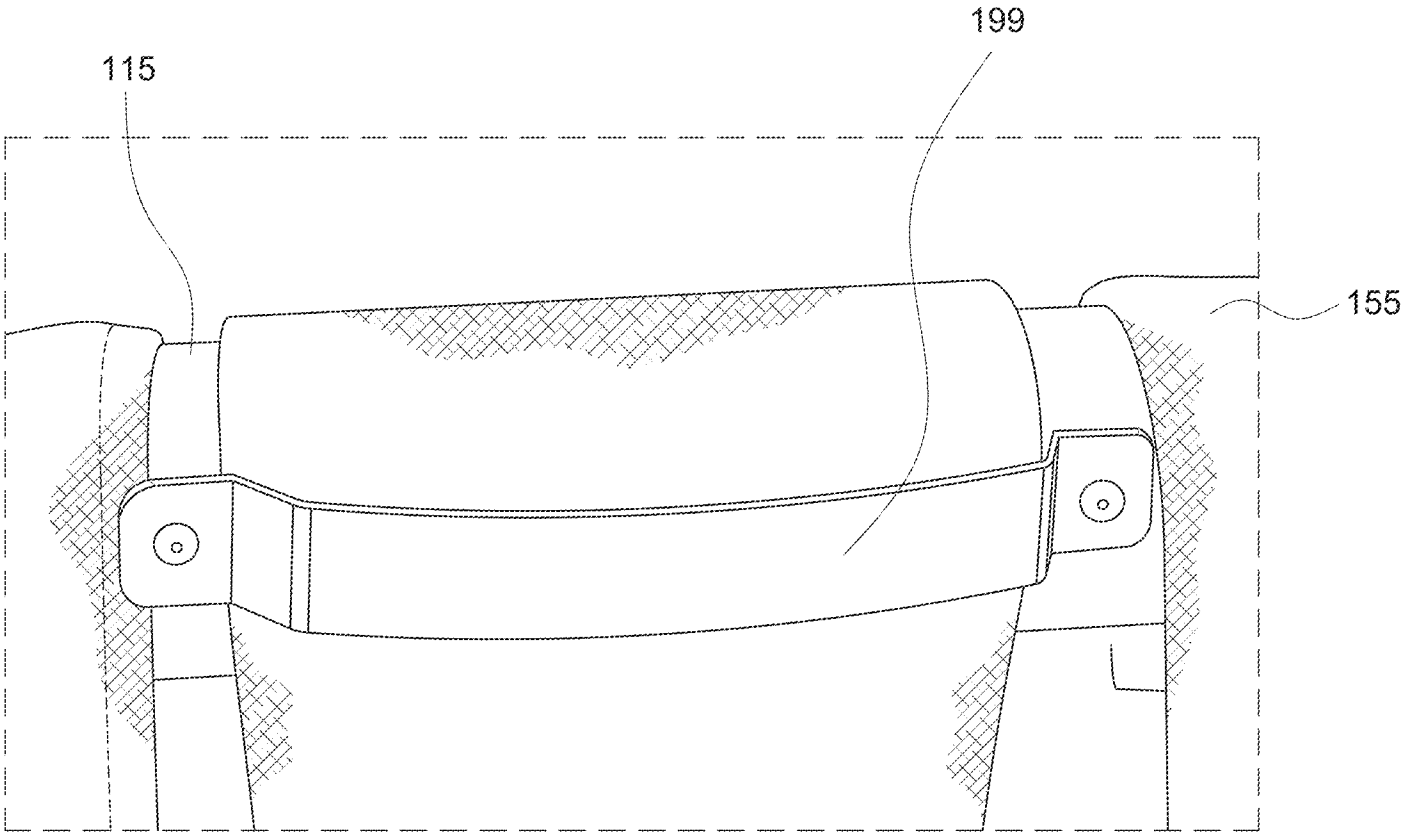
FIG. 15 illustrates an example of a handle connected to the back support frame element.

Referring to FIG. 15, the folding chair 100 can further include a handle 199 connected to the top of the rear back support frame element 115 and spanning a back support web element 155 for carrying the folding chair.

Figure 16:
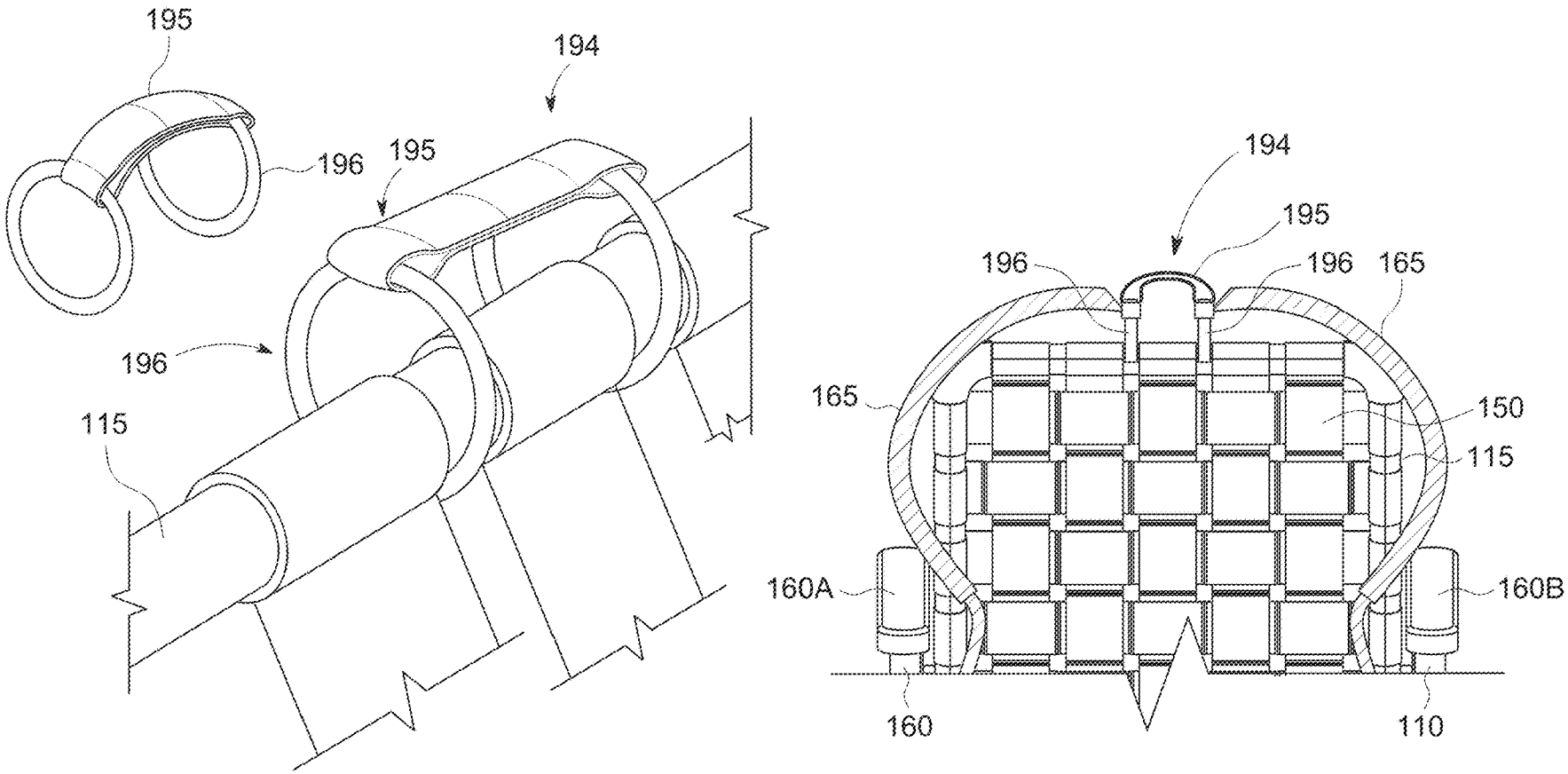
FIG. 16 illustrates an example of a handle that can be used as a connector for carrying straps in a backpack carrying configuration.

Referring to FIG. 16, the folding chair 100 another example of a handle 194 is illustrated. The handle 194 being connected to two loops of cord 196, the loops being disposed around the upper back support frame element 115. The loops are connectable to first ends of two carrying straps 165. Second ends of the two carrying straps 165 are connected to the left and right rear joint strap connectors 182 (not shown) for carrying the folding chair in a back pack configuration.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A folding chair, comprising:

a front leg frame;

a rear leg frame;

a back frame;

a support rod;

a seat frame pivotally coupled to the front leg frame and the back frame;

a left arm support pivotally coupled to the front leg frame and the rear leg frame; and a right arm support pivotally coupled to the front leg frame and the rear leg frame;

a left front joint pivotally coupling the front leg frame to the seat frame;

a right front joint pivotally coupling the front leg frame to the seat frame;

a left rear coupling pivotally connecting the rear leg frame to the back frame and pivotally connecting the rear leg frame to the support rod;

a right rear coupling pivotally connecting the rear leg frame to the back frame and pivotally connecting the rear leg frame to the support rod;

an accessory connector secured to the front leg frame and configured to detachably connect to an interchangeable accessory, wherein the accessory connector is secured to the front leg frame via the left front joint or the right front joint;

a handle secured to the back frame;

a first backpack strap connectable to the handle and a first connector on the back frame; and a second backpack strap connectable to the handle and a second connector on the back frame.

2. The folding chair of claim 1, a wherein the support rod pivotally connects the seat frame to the left rear coupling and the right rear coupling.

3. The folding chair of claim 2, wherein the support rod allows the back frame to rotate with respect to the seat frame.

4. The folding chair of claim 1, wherein the interchangeable accessory includes a projection and the accessory connector includes a slot configured to receive the projection.

5. The folding chair of claim 1, wherein the accessory connector is secured to the front leg frame via the left front joint and the folding chair comprises a second accessory connector secured to the front leg frame via the right front joint.

6. The folding chair of claim 1, wherein the interchangeable accessory is a cupholder with one or more cutouts to accommodate cups of different sizes and shapes.

7. The folding chair of claim 6, wherein at least one of the one or more cutouts is configured to receive a cup handle.

8. The folding chair of claim 1, wherein strips of back support material extend from an upper portion of the back frame to a lower portion of the back frame.

9. A folding chair, comprising:

a front leg frame;

a rear leg frame;

a left arm support pivotally coupled to the front leg frame and the rear leg frame;

a right arm support pivotally coupled to the front leg frame and the rear leg frame;

a support rod;

a seat frame pivotally coupled to the front leg frame;

a back frame pivotally coupled to the support rod, the left arm support, and the right arm support;

a first plurality of connectors coupled to the seat frame;

an insulated container disposed beneath the seat frame, the insulated container comprising a second plurality of connectors and a fourth plurality of connectors; and a third plurality of connectors coupled to the support rod, wherein the second plurality of connectors are configured to detachably connect to the first plurality of connectors to secure the insulated container to the seat frame, and the fourth plurality of connectors are configured to detachably connect to the third plurality of connectors.

10. The folding chair of claim 9, further comprising a left rear coupling pivotally connecting the rear leg frame to the support rod.

11. The folding chair of claim 9, further comprising a right rear coupling pivotally connecting the rear leg frame to the support rod.

12. The folding chair of claim 9, further comprising a plurality of carrying straps secured to the back frame and the support rod.

13. The folding chair of claim 9, further comprising a cup holder secured to at least one of the left arm support or the right arm support.

14. The folding chair of claim 9, wherein the support rod is configured to allow the back frame to rotate with respect to the seat frame.

15. The folding chair of claim 9, further comprising a left front joint pivotally coupling the front leg frame to the seat frame.

16. The folding chair of claim 9, further comprising a right front joint pivotally coupling the front leg frame to the seat frame.

17. A folding chair, comprising:

a front leg frame;

a rear leg frame;

a left arm support pivotally coupled to the front leg frame and the rear leg frame;

a right arm support pivotally coupled to the front leg frame and the rear leg frame;

a support rod;

a seat frame pivotally coupled to the front leg frame;

a back frame pivotally coupled to the support rod, the left arm support, and the right arm support;

a left rear coupling pivotally connecting the rear leg frame to the support rod;

a right rear coupling pivotally connecting the rear leg frame to the support rod;

a first plurality of connectors coupled to the seat frame; and an insulated container disposed beneath the seat frame, the insulated container comprising a second plurality of connectors configured to detachably connect to the first plurality of connectors to secure the insulated container to the seat frame.

18. The folding chair of claim 17, further comprising a plurality of carrying straps secured to the back frame and the support rod.

19. The folding chair of claim 17, further comprising a cup holder secured to at least one of the left arm support or the right arm support.

20. The folding chair of claim 17, wherein the insulated container is detachably connected to the support rod.

* * * * *